US007238097B2

(12) United States Patent
Ohno et al.

(10) Patent No.: US 7,238,097 B2
(45) Date of Patent: Jul. 3, 2007

(54) POLISHING PAD AND METHOD OF PRODUCING SAME

(75) Inventors: Hisatomo Ohno, Tokyo (JP); Toshihiro Izumi, Tokyo (JP); Mitsuru Saito, Tokyo (JP); Takuya Nagamine, Tokyo (JP); Claughton Miller, Hayward, CA (US); Ichiro Kodaka, Hayward, CA (US)

(73) Assignee: NIHON Microcoating Co., Ltd., Tokyo (JP)

( * ) Notice: Subject to any disclaimer, the term of this patent is extended or adjusted under 35 U.S.C. 154(b) by 23 days.

(21) Appl. No.: 11/010,199

(22) Filed: Dec. 10, 2004

(65) Prior Publication Data

US 2005/0142996 A1 Jun. 30, 2005

Related U.S. Application Data

(63) Continuation of application No. PCT/JP04/05078, filed on Apr. 8, 2004.

(30) Foreign Application Priority Data

Apr. 11, 2003 (JP) ..... 2003-107863
Apr. 8, 2004 (JP) ..... PCT/Jp04/05078

(51) Int. Cl.
*B24D 11/00* (2006.01)

(52) U.S. Cl. ..... 451/527; 451/530; 451/533

(58) Field of Classification Search ..... 451/527, 451/530, 533, 537, 538, 6; 438/690, 692
See application file for complete search history.

(56) References Cited

U.S. PATENT DOCUMENTS

| | | | | |
|---|---|---|---|---|
| 5,605,760 | A * | 2/1997 | Roberts | 428/409 |
| 5,893,796 | A * | 4/1999 | Birang et al. | 451/526 |
| 6,524,164 | B1 * | 2/2003 | Tolles | 451/6 |
| 6,641,471 | B1 * | 11/2003 | Pinheiro et al. | 451/526 |
| 6,855,034 | B2 * | 2/2005 | Hasegawa | 451/41 |

FOREIGN PATENT DOCUMENTS

| | | |
|---|---|---|
| JP | 10-83977 | 3/1998 |
| JP | 11-512977 | 11/1999 |
| JP | 2001-179607 | 7/2001 |
| JP | 2002-324770 | 11/2002 |
| JP | 2003-48151 | 2/2003 |
| WO | WO 01/91971 | 6/2001 |

* cited by examiner

*Primary Examiner*—Dung Van Nguyen
(74) *Attorney, Agent, or Firm*—Beyer Weaver & Thomas LLP

(57) ABSTRACT

A transparent pad having a polishing surface with an average surface roughness of 5 μm or less is used as a polishing pad. An indentation is formed on the back surface of the transparent pad such that its rate of light transmission is locally changed. The transparent pad has a rate of light transmission equal to or greater than 10% or preferably 30% for light of at least one wavelength in the range of 350 nm–900 nm.

16 Claims, 7 Drawing Sheets

POLISHING PAD AND METHOD OF PRODUCING SAME

This application is a Continuation application of copending prior-filed International (designating the United States) Application No. PCT/JP2004/005078 filed Apr. 8, 2004, from which priority is claimed, claiming priority also on Japanese Patent Application 2003-107863 filed Apr. 11, 2003.

BACKGROUND OF THE INVENTION

This invention relates to a polishing pad for polishing the surface of a target object requiring a high degree of flatness and smoothness such as a semiconductor wafer and a semiconductor device wafer, as well as to a method of producing such a polishing pad. More particularly, this invention relates to a polishing pad suitable for a polishing process by a polishing technology of judging the time of finishing a polishing process and a method of producing such a polishing pad.

In general, the surface of such a target object requiring a high degree of flatness and smoothness is polished by rotating a lapping plate with a polishing pad pasted on its surface, supplying polishing slurry to the surface of this polishing pad and pressing the surface of the target object thereon. Examples of the slurry to be used for such a purpose include those obtained by dispersing abrading particles for mechanically polishing the surface of the target object inside water or a water-based aqueous solution containing glycols or alcohols and further adding thereto a chemical capable of chemically reacting with the surface of the target object. Such a chemical may be appropriately selected, depending on the material comprising the surface of the target object (or the "target surface"). If the target surface is silicon dioxide, for example, potassium hydroxide, tetramethyl ammonium hydroxide, hydrofluoric acid and fluorides may be used. If the target surface is tungsten, iron nitride and potassium iodate may be used, and if the target surface is copper, glycine, quinaldinic acid, hydrogen peroxide and benzotriazol may be used. Particles of alumina, silica, ceria and diamond with average diameter in the range of 0.001–1 μm are used as the polishing particles.

As for the polishing pad, non-woven cloth pads with an uneven surface (formed by the fiber structure of the surface layer) capable of holding or capturing abrading particles on the surface and pads of a foamed material with an uneven surface formed by air bubble gaps exposed to the surface may be used. During the polishing, the abrading particles between the surface of the polishing pad and the surface of the target object are held or captured on the surface of the polishing pad and move relative to the target object by following the motion of the polishing pad. Since the chemical in the polishing slurry reacts chemically with the surface of the target object, the impurities generated on the surface of the target object are mechanically removed such that the target surface is polished. This is referred to as the chemical mechanical polishing.

As a representative example, a semiconductor device wafer is produced by forming a multi-layer wiring structure on a semiconductor wafer by means of the multi-layer wiring technology. In the above, the multi-layer wiring structure is obtained by using a known thin-film or etching technology to pile up membranes made of materials which are different in hardness such as insulating and metallic membranes and forming very small and complicated multi-layer wiring patterns with different widths and pitching by etching. If there is unevenness on the surface after the film-forming process and after the etching process, steps are formed on the membrane due to this unevenness, and since these steps tend to cause short circuits among the wires, a high level of flatness and smoothness is required on the surface after the film-forming and etching processes. This is why the aforementioned chemical mechanical polishing is practiced.

Besides, each of the membranes in the multi-layer wiring structure of a semiconductor device wafer is required to be polished to a specified thickness and this means that the polishing process must be stopped at the precise moment at which the membrane being polished comes to be of a specified thickness. For this reason, a polishing technology that judges the time to stop the polishing (or the time at which the membrane being polished becomes of a specified thickness) is employed for the polishing of a target object such as a semiconductor wafer and a semiconductor device wafer that requires a high level of flatness and smoothness on its surface.

According to this polishing technology, as disclosed in U.S. Pat. No. 5,893,796 and Japanese Patent Publications Koho 3,326,443 and Tokkai 2003-68686, for example, light is applied onto the target surface of a target object being polished and the reflected light beam is received by an optical sensor and monitored such that the moment at which the membrane being polished comes to have a specified thickness.

As shown in FIGS. 10A and 10B, a polishing process according to this technology is carried out by using a lapping plate 31 on the surface of which is pasted a polishing pad 20 as shown in FIG. 11 through an adhesive 22 applied to its back surface, as in the case of chemical mechanical polishing explained above. As the lapping plate 31 is rotated in the direction shown by arrow R, polishing slurry is supplied to the surface of the polishing pad 20 through a nozzle 35, and the surface of a target object W held by a holder 34 is pressed thereon and rotated in the direction of arrow r.

Since the change in the reflectivity of light on the target surface needs to be monitored, the lapping plate 31 of the polishing device 30*a* shown in FIG. 10A is provided with a throughhole 36 which penetrates it in the vertical direction and an optical sensor 33 having a light-emitting element and a light-receiving element is disposed below this throughhole 36, as shown, for example, in aforementioned U.S. Pat. No. 5,893,796 and Japanese Patent Publication Koho 3,326,443.

A lid 32 made of a transparent resin material is affixed to the upper end of this throughhole 36 such that its upper surface is on the same plane as the surface of the lapping plate 31. As shown in FIG. 11, the polishing pad 20 is provided with a window 21 at a position corresponding to the throughhole 36 through the lapping plate 31.

With the polishing device 30*b* shown in FIG. 10B, the optical sensor 33 similarly provided with a light-emitting element and a light-receiving element is disposed inside an indentation with an opening on the surface of the lapping plate 31, as shown, for example, in aforementioned Japanese Patent Publication Tokkai 2003-68686. A similar lid 32 made of a transparent resin material is affixed at the opening of this indentation with its upper surface on the plane as the surface of the lapping plate 31. The polishing pad 20 is provided with a window 21 at a position corresponding to the optical sensor 33 attached to the lapping plate 31 inside the indentation.

Such a prior art polishing pad has an approximately elliptical slot formed so as to completely penetrate it in the vertical direction, as shown in FIG. 11. According to the disclosures in aforementioned U.S. Pat. No. 5,893,796 and Japanese Patent Publications Koho 3,326,443 and Tokkai 2003-68686, the window 21 is formed in such a shape that would fit the slot such that the pad is attached by inserting the window into this slot. In other words, prior art polishing pads as explained above require the cumbersome processes of forming a slot therethrough, producing a window that would correctly match this slot in shape and inserting the window into the slot through the polishing pad.

There are other problems with the prior art. Since a window made of a harder resin material is attached to the elastic polishing pad made of an unwoven cloth material or a foamed material, there is a difference in hardness between the polishing pad and the window. As a result, a difference appears in the force acting on the window and the portions of the polishing pad near the window during a polishing process such that the surface portions of the polishing pad near the window come to be distorted or cracked. Thus, the force securing the window becomes weaker and the window may become displaced or the polishing pad may become destroyed, causing the polishing slurry to leak to the backside of the polishing pad and to adversely affect the force with which the polishing pad sticks to the lapping plate. Since there is the aforementioned difference in hardness between the polishing pad and the window, there is also a difference between them in the degree of surface wears and a step may appear on the surface of the polishing pad. Such a step tends to cause scratches and waviness on the surface and the target surface cannot be polished evenly thereby.

In the case of an elastic polishing pad made of an unwoven cloth or a foamed material, furthermore, since the target object being polished sinks into the polishing pad and undergoes a large local deformation during the polishing process, the surface of the polishing pad cannot be applied stably and uniformly all over the surface of the target object and hence the surface of the target object cannot be polished uniformly.

Thus, a prior art polishing pad cannot stably polish the surface of a target object smoothly and flatly by using the aforementioned polishing technology for judging the time for ending the polishing.

SUMMARY OF THE INVENTION

It is therefore an object of this invention to provide a polishing pad capable of stably polishing the surface of a target object evenly and smoothly by using the polishing technology for judging the time for ending the polishing, as well as a method of producing such a polishing pad.

Such a polishing pad embodying this invention is characterized as being made of a transparent material and having a polishing surface capable of holding or capturing abrading particles and causing them to act on the target surface to be polished during a polishing process. For this purpose, the polishing surface has a sufficient average surface roughness Ra for holding or capturing the abrading particles in the polishing slurry. The average surface roughness Ra may be selected appropriately, depending on the size of the abrading particles contained in the polishing slurry. It may be in a range of equal to or less than 5 μm for the polishing of the surface of a semiconductor wafer or a semiconductor device wafer, or more preferably in the range of 1 μm–5 μm.

The transparent pad has an indentation on its back surface. This is such that the corresponding portion becomes thinner and hence the transparency is improved. In other words, transparency of the transparent pad of this invention can be locally changed by forming such an indentation. Since such an indentation is formed on the back surface, there does not appear any step on the front surface. The indentation may be formed at any position on the back surface and may assume any shape such as a concentric circle, a spiral, a straight line or a dot, as long as a specified portion of the pad can be made thinner.

Grooves may be provided on the front surface of the transparent pad for the purpose of more uniformly supplying the polishing slurry over the surface of a target object to be polished that is pressed against the surface of the transparent pad and also of discharging contaminants such as debris generated by a polishing process. The grooves may be radial, spiral of lattice-shaped as long as they can function as a flow route of the polishing slurry.

Transparency of the transparent pad is equal to or greater than 10% or preferably equal to or greater than 30% for light of at least one wavelength within the range of 350 nm–900 nm. For example, transparency may be equal to or greater than 10% for light of wavelength in the range of 370 nm–900 nm or in the range of 390 nm–900 nm. Transparency may be equal to or greater than 30% for light of wavelength in the range of 400 nm–900 nm or in the range of 450 nm–900 nm.

The transparent pad having such transparency may comprise a non-foamed resin material of polyurethane, polyethylene, polystyrene, vinyl polychloride or acryl type. A resin material with purity equal to or greater than 60%, or preferably 90% is used.

The polishing pad according to this invention may further include an adhesive layer formed on the back surface of the transparent pad 11. An adhesive with transparency to light such as polyester, polyethylene, epoxy, polyurethane, acryl or natural rubber type is used for this purpose.

The polishing pad of this invention may comprise a back sheet produced by forming a first adhesive layer made of a transparent adhesive agent on the surface of a transparent base sheet and further forming a second adhesive layer of a transparent adhesive agent on the back surface of the base sheet. This back sheet is attached to the back surface of the aforementioned transparent pad through the first adhesive layer. The transparent base sheet comprises a non-foamed resin material of polyurethane, polyethylene, polystyrene, vinyl polychloride or acryl type.

The polishing pad of this invention may be produced with a back sheet obtained by forming a first adhesive layer on the front surface of an elastic sheet of a non-woven cloth or foamed material and forming a second adhesive layer on the back surface of this elastic sheet. Since this elastic sheet does not allow light to pass through, a throughhole is preliminarily formed to penetrate it from its front surface to its back surface at a position corresponding to the lid on the surface of the lapping plate. This back sheet is attached to the back surface of the aforementioned transparent pad through the first adhesive layer. If the first adhesive layer or the second adhesive layer is formed so as to cover the slot partially or completely, a transparent adhesive is to be employed.

With the polishing pad having an adhesive layer formed or a back sheet attached on the back surface of the transparent pad, the judgment of the time to end the polishing process may not be made accurately if the transparency is less than 10%. It is therefore preferable that the transparent pad should have transparency equal to or greater than 10% or preferably equal to or greater than 30% for light of at least one wavelength within the range of 350 nm–900 nm. For example, transparency may be equal to or greater than 10% for light of wavelength in the range of 370 nm–900 nm or in the range of 390 nm–900 nm. Transparency may be equal to or greater than 30% for light of wavelength in the range of 400 nm–900 nm or in the range of 450 nm–900 nm.

The polishing pad of this invention is produced by firstly obtaining the transparent pad having the polishing surface by preparing a planar non-foamed member by filling a molding block with a liquid mixture of a resin material of polyurethane, polyethylene, polystyrene, vinyl polychloride or acryl type and a hardening agent and hardening this mixture, abrading both surfaces of this planar member to a specified thickness and polishing both surfaces.

The present invention has the following merits. Firstly, the present invention removes the necessity for providing a slot for a window in the polishing pad or a window that matches the slot, or for inserting the window for affixing it. Secondly, since there is no difference in hardness on the surface of the polishing pad, the rate of abrasion is uniform over the surface and scratches and waviness are not caused on the surface of the target object. Since the surface of the polishing pad does not become distorted and the polishing pad does not become destroyed during a polishing process, the polishing slurry does not leak to the back surface of the polishing pad. Thirdly, since the transparent pad is made of a non-foamed material, the target object does not sink into the polishing pad or cause the polishing pad to undergo a significant elastic deformation. Thus, the surface of the polishing pad can act uniformly on the target surface. In summary, the target surface can be polished uniformly by using the polishing technology for judging the time to end the polishing.

DETAILED DESCRIPTION OF THE INVENTION

Figure 10A:
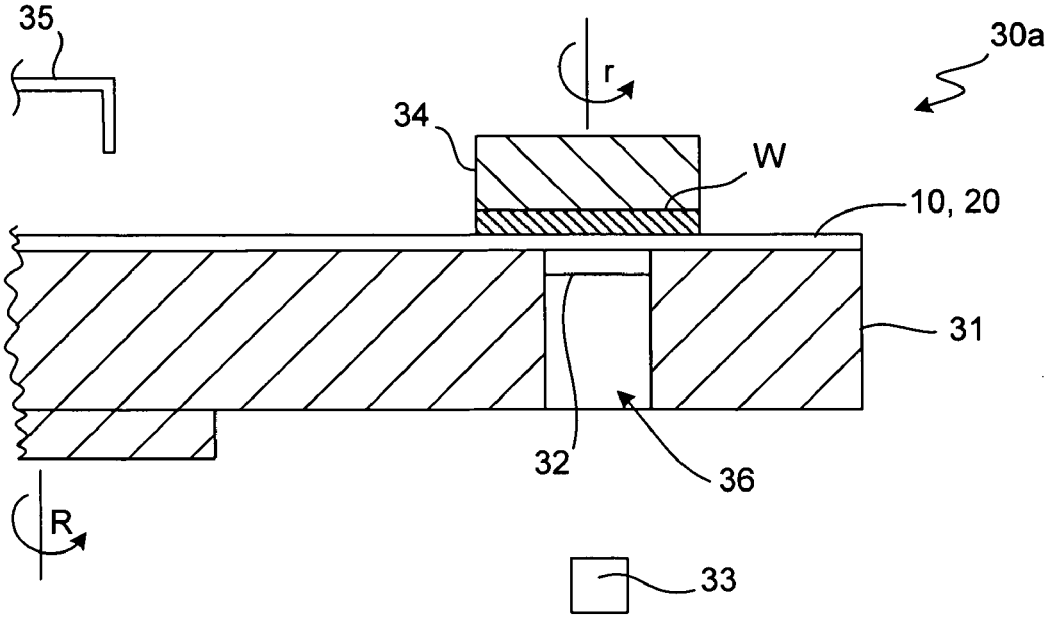
FIGS. 10A and 10B are sectional views of polishing devices adapted to use a polishing pad embodying this invention.
Figure 10B:
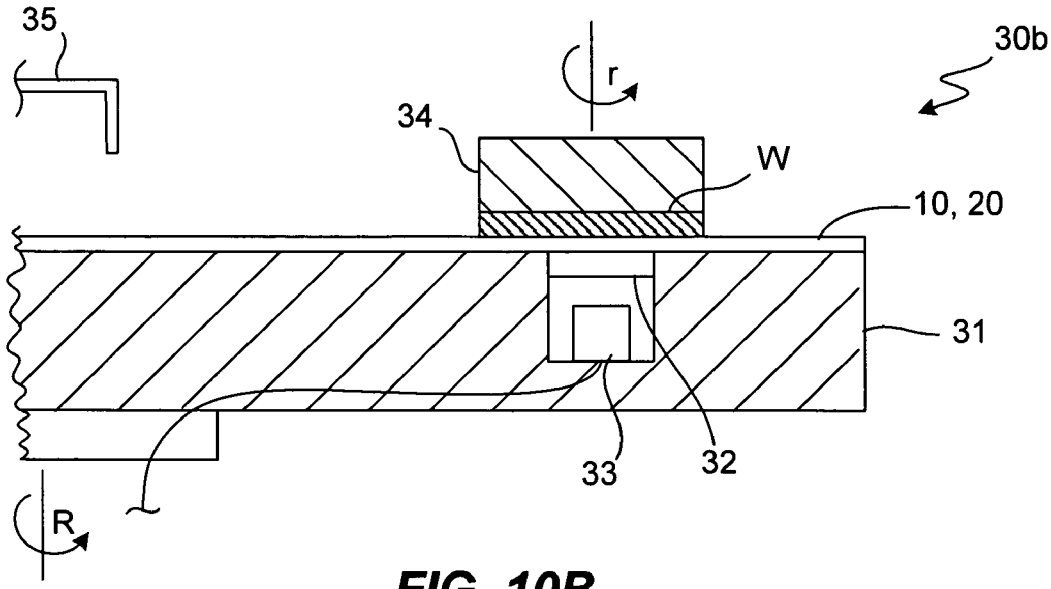

FIGS. 10A and 10B show polishing devices 30*a* and 30*b*, each of which is adapted to use a polishing pad 10 embodying this invention for polishing the surface of a target object requiring a high level of smoothness and flatness such as a semiconductor wafer or a semiconductor device wafer by using a polishing technology for judging the time to end the polishing.

Both of these polishing devices 30*a* and 30*b* comprise a lapping plate 31 on the surface of which the polishing pad 10 is attached. The polishing is carried out with both by rotating the lapping plate 31 in the direction of arrow R, supplying polishing slurry to the surface of the polishing pad 10 through a nozzle 35, pressing the surface of a target object W held by a holder 34 on it and causing it to rotate in the direction of arrow r. The so-called chemical mechanical polishing may be carried out by adding to the polishing slurry a chemical that reacts chemically with the surface of the target object W.

With the polishing device 30*a* shown in FIG. 10A, the lapping plate 31 is provided with a throughhole 36 that vertically penetrates it and an optical sensor 33 having a light-emitting element and a light-receiving element is disposed below the target object W being held by the holder 34. When the throughhole 36 through the lapping plate 31 passes over the surface of the target object W (the target surface) during a polishing process, or when the optical sensor 33, the throughhole 36 and the target surface are aligned on a single straight line, light from the light-emitting element (not shown) of the optical sensor 33 reaches the target surface through the throughhole 36 and a lid 32 and its reflected light is received by the light-receiving element (not shown) of the optical sensor 33 through the throughhole 36 and the lid 32. The change in the light reflectivity of the target surface is monitored such that the time to stop the polishing process is judged.

With the polishing device 30*b* shown in FIG. 10B, an optical sensor 33 having a light-emitting element and a light-receiving element is mounted inside an indentation which opens to the surface of the lapping plate 31. During a polishing process, light emitted from the light-emitting element (not shown) of the optical sensor 33 reaches the target object W and the reflected light is received by the light-receiving element (not shown) of the optical sensor 33 when the optical sensor 33 passes the surface (the target surface) of the target object W such that the change in the light reflectivity of the target surface is monitored and the time to end the polishing process is judged.

Figure 1A:
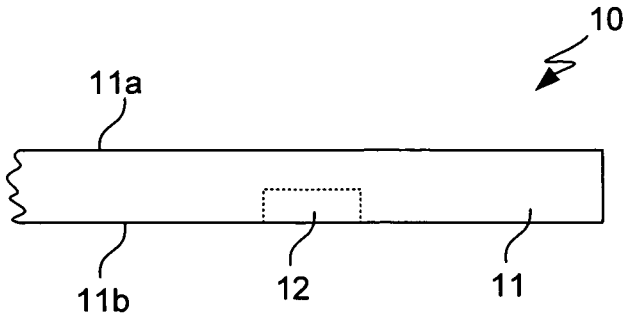
FIG. 1A is a sectional view of a polishing pad according to a first embodiment of this invention and FIGS. 1B, 1C and 1D are each a sectional view of a lapping plate.
Figure 1B:
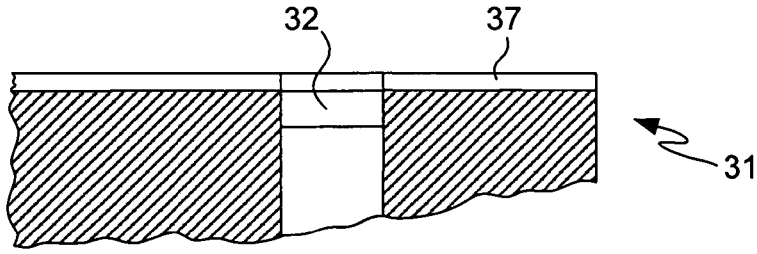
Figure 1C:
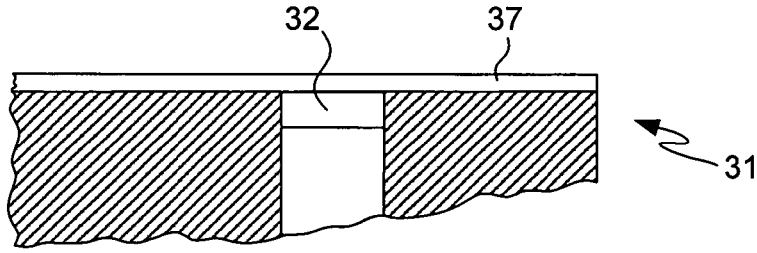
Figure 1D:
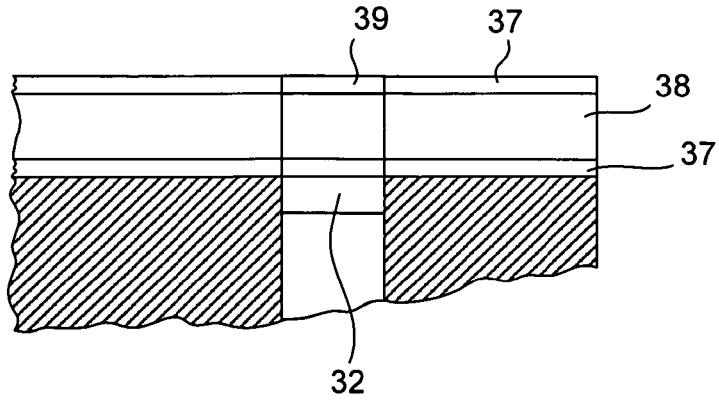

The polishing pad 10 shown in FIGS. 10A and 10B, as being used with the polishing devices 30*a* and 30*b* is shown more in detail in FIG. 1A as a transparent pad 11 having a polishing surface 11*a*. As shown in FIGS. 1B and 1C, this polishing pad 10 is attached to the surface of the lapping plate 31 through an adhesive 37 applied to the surface of the lapping plate 31. As shown in FIG. 1D, the transparent pad 11 may be pasted through an adhesive 37 on the surface of an elastic sheet 38 which is pasted on the surface of the lapping plate 31 through another adhesive layer 37 (corresponding to the "first adhesive layer 15" shown in FIGS. 3A and 3B). A transparent sheet may be used as the elastic sheet 38 (such as the transparent base sheet 16 shown in FIG. 3A). If an elastic sheet which is not transparent (such as the elastic sheet 16' shown in FIG. 3B) is used as the elastic sheet 38, a slot 39 (such as the slot 18 shown in FIG. 3B) is formed therethrough from its front surface to the back surface.

The adhesive 37 may be applied all over the surface of the lapping plate 31 except the surface of the lid 32, as shown in FIG. 1B. If the adhesive 37 is applied all over the surface of the lapping plate 31, as shown in FIG. 1C, a transparent adhesive such as polyester type, polyethylene type, epoxy type, polyurethane type, acryl type and natural rubbers may be used.

The polishing surface 11*a* of the transparent pad 11 of this invention is adapted to hold or capture the abrading particles in the polishing slurry and to cause them to act on the surface of the target object W to be polished. For this purpose, the polishing surface 11*a* is prepared to have an average surface roughness Ra in an appropriate range such that the abrading particles in the polishing slurry can be held or captured. The average surface roughness of the polishing surface 11*a* can be appropriately selected by way of the size of the abrading particles in the polishing slurry, etc. and is preferably 5 μm or less and more preferably in the range of 1 μm–5 μm when the polishing pad 11 is used for polishing the surface of a semiconductor wafer or a semiconductor device wafer.

Figure 4A:
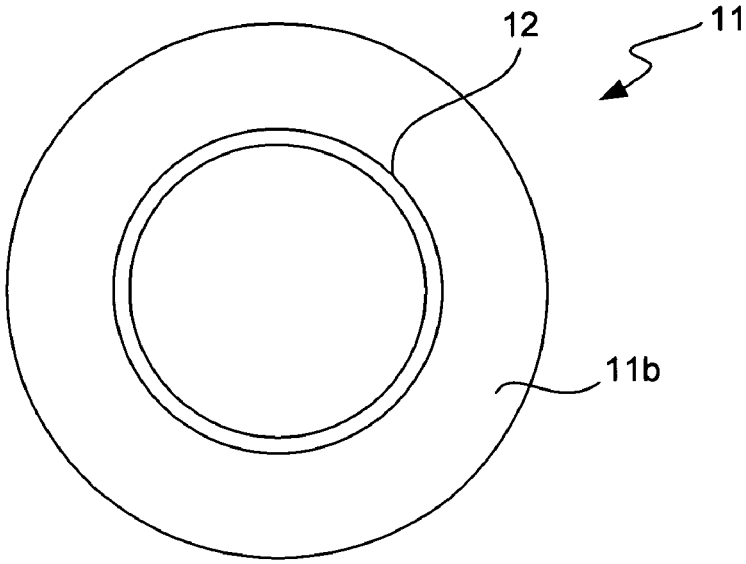
FIGS. 4A and 4B, which may together be referred to as FIG. 4, show examples of the planar shape of the indentation formed on the back surface of a transparent pad embodying this invention.
Figure 4B:
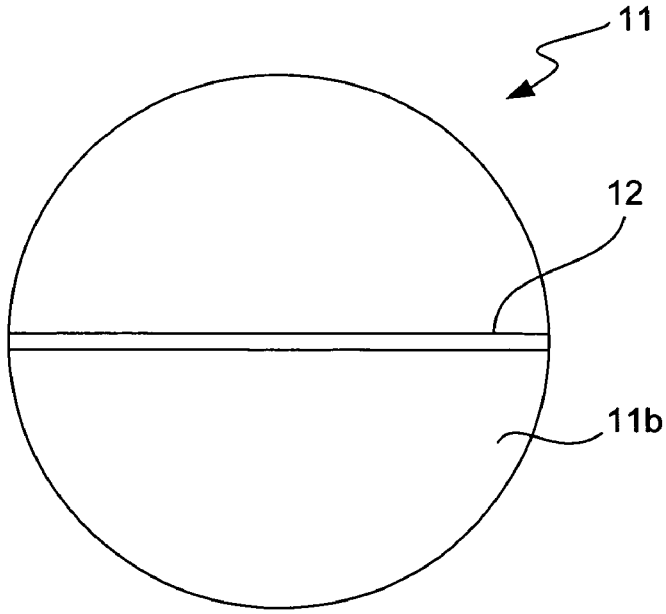

The transparent pad 11 of this invention may have an indentation 12 as shown in FIG. 1A (and also in FIG. 6) on its back surface 11*b*. This is for the purpose of reducing the thickness of this portion of the pad 11 so as to increase its optical transparency. In other words, the transparency of the pad 11 is locally increased by way of such an indentation 12. The reason for forming such an indentation on the back surface 11*b*, instead of on its front surface, is so that there will be no step on the front surface of the pad 11. Such an indentation 12 may be formed at any convenient position corresponding to the lid 32 of the lapping plate 31 on the back surface 11*b*. The indentation 12 may be of a spiral shape or a dot (formed merely by digging into the pad at a desired position to a desired depth). The indentation 12 may be a groove in the shape of concentric circles as shown in FIG. 4A or a straight line along a diameter as shown in FIG. 4B. It goes without saying that the transparency increases as the indentation 12 is made deeper (to make the corresponding portion of the pad 11 thinner).

If the adhesive 37 is applied all over the surface of the lapping plate 31, as shown in FIG. 1C, the rate of light transmission through the portion corresponding to the lid 32 drops because of the portion of the adhesive 37 applied to the surface of the lid 32 on the lapping plate 31 through which pass the incident light onto the target surface and the reflected light from the target surface. For this reason, the portion of the polishing pad 10 above the lid 32 on the surface of the lapping plate 31 may be made thinner such that the rate of light transmission through this portion will be improved. This can be done by forming the indentation 12 as shown by broken lines in FIG. 1A.

Figure 5A:
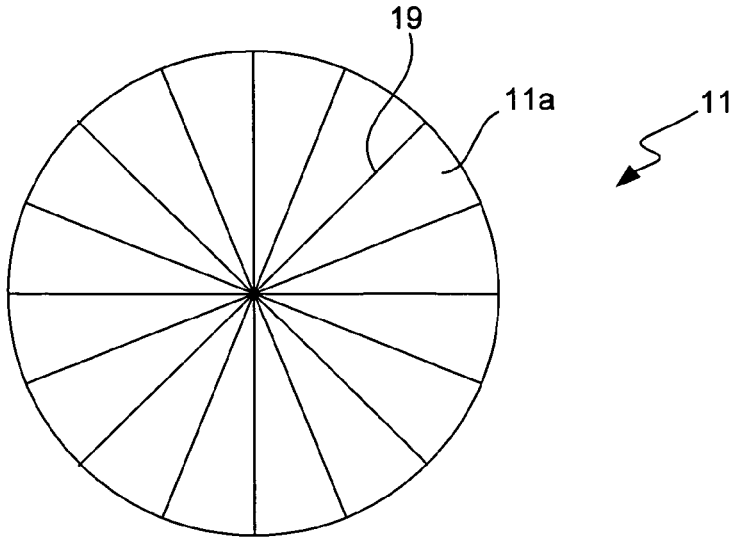
FIGS. 5A and 5B, which may together be referred to as FIG. 5, show examples of the planar shape of the grooves formed on the front surface of a transparent pad embodying this invention.
Figure 5B:
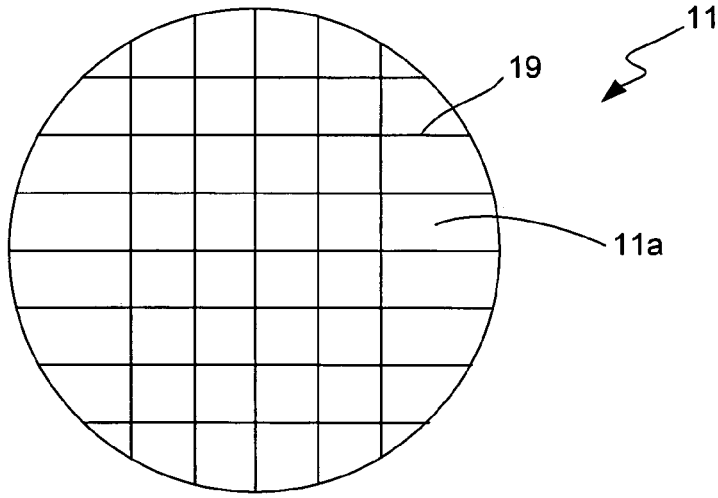
Figure 6:
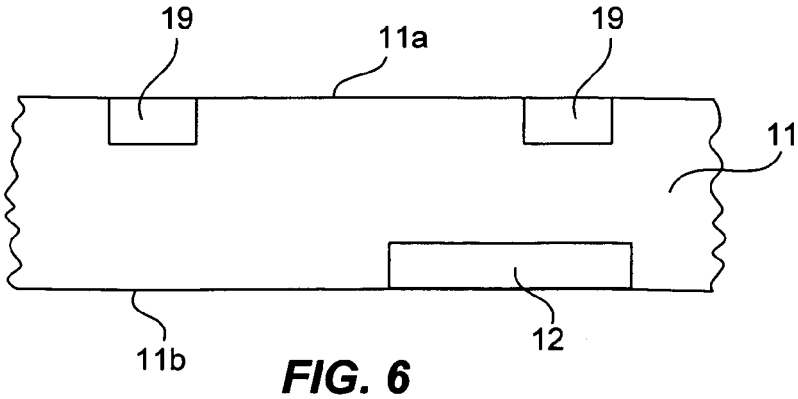
FIG. 6 is a sectional view of a transparent pad with an indentation shown in FIG. 4 and grooves shown in FIG. 5 formed thereon.

As shown in FIG. 6, the optical pad 11 of this invention has grooves 19 formed on its front surface. These grooves 19 serve to uniformly supply polishing slurry over the target surface of the target object W which is pressed against the front surface and also to discharge contaminants such as debris generated during a polishing process. The invention does not impose any particular limitations regarding their shapes, as long as the grooves 19 are capable of functioning as efficient flow routes for the polishing slurry supplied to the surface of the optical pad. They may be arranged radially as shown in FIG. 5A or in a lattice formation as shown in FIG. 5B. With grooves thus formed on the surface of the transparent pad 11, light is absorbed or scattered by the polishing slurry which flows therein during a polishing process, and the transparency becomes reduced where the grooves 19 are formed. It is therefore preferable to form the aforementioned indentation 12 on the back surface 11*b* opposite where the grooves 19 are formed, as shown in FIG. 6, such that the transparency characteristic is improved.

Since the judgment of the time to end the polishing process may not be made accurately if the transparency is less than 10%, it is preferable that the transparent pad 11 should have transparency equal to or greater than 10% or preferably equal to or greater than 30% for light of at least one wavelength within the range of 350 nm–900 nm. For example, transparency may be equal to or greater than 10% for light of wavelength in the range of 370 nm–900 nm or in the range of 390 nm–900 nm. Transparency may be equal to or greater than 30% for light of wavelength in the range of 400 nm–900 nm or in the range of 450 nm–900 nm.

The transparent pad 11 having such transparency may comprise a non-foamed resin material of polyurethane, polyethylene, polystyrene, vinyl polychloride or acryl type. A resin material with purity equal to or greater than 60%, or preferably 90% is used. Higher transparency can be obtained by using a material with a higher level of purity. Since these non-foamed materials are relatively harder and less elastic than formed materials, the target object W does not sink into the polishing pad 10 or cause the polishing pad 10 to be deformed significantly, and hence the surface of the polishing pad 10 can stably operate over the target surface of the target object W in an uniform manner.

Figure 2A:
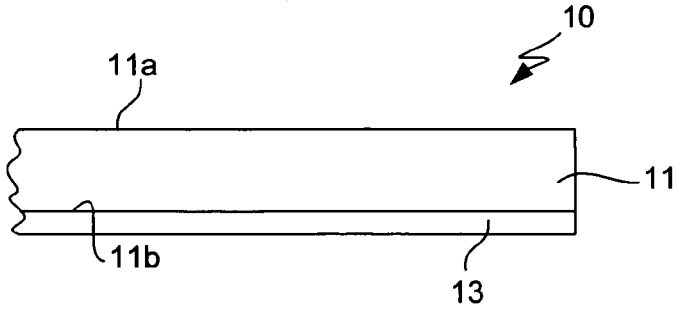
FIGS. 2A and 2B, which may together be referred to as FIG. 2, are each a sectional view of a polishing pad according to a second embodiment of the invention.

The polishing pad 10 according to this invention may further include an adhesive layer 13 formed on the back surface 11*b* of the transparent pad 11, as shown in FIG. 2A. This polishing pad 10 is adapted to be attached to the lapping plate 31 of the polishing devices 30*a* and 30*b* shown in FIGS. 10A and 10B through this adhesive layer 13. Although not shown in the drawings, a paper sheet for separation is pasted onto the back surface of this adhesive layer 13 in order to prevent it from drying. At the time of an actual use, this paper sheet is peeled off by the user before the polishing pad 10 is pasted onto the surface of the lapping plate 31.

Figure 2B:
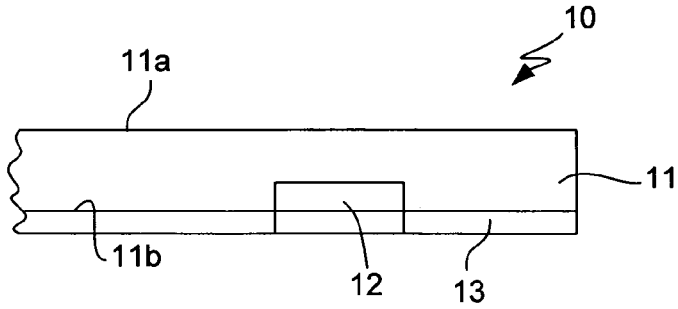

An adhesive with transparency to light such as polyester, polyethylene, epoxy, polyurethane, acryl or natural rubber type is used. As shown in FIG. 2B, the polishing pad 10 may be provided with the aforementioned indentation 12 on its back surface 11*b*. The aforementioned grooves 19 may also be formed on its front surface.

Figure 3A:
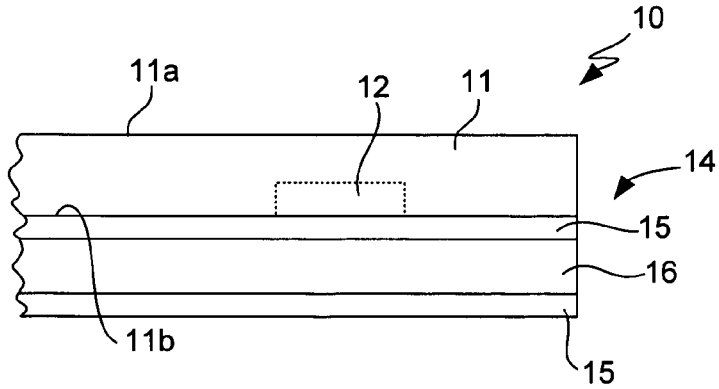
FIGS. 3A and 3B, which may together be referred to as FIG. 3, are each a sectional view of a polishing pad according to a third embodiment of the invention.

As shown in FIG. 3A, the polishing pad 10 of this invention may comprise a back sheet 14 produced by forming a first adhesive layer 15 made of a transparent adhesive agent on the surface of a transparent base sheet 16 and further forming a second adhesive layer 17 of a transparent adhesive agent on the back surface of the base sheet 16. This polishing pad 10 is adapted to be attached to the lapping plate 31 of the polishing devices 30*a* and 30*b* shown in FIGS. 10A and 10B through the second adhesive layer 17. Although not shown in the drawings, a paper sheet for separation is pasted onto the front surface of the first adhesive layer 15 and the back surface of the second adhesive layer 17 in order to prevent them from drying. Prior to an actual use, the paper sheet on the surface of the first adhesive layer 15 is peeled off by the user and the back sheet 14 is pasted onto the back surface of the polishing pad 10 through the first adhesive layer 15. At the time of the actual use, the paper sheet on the back surface of the second adhesive layer 17 is peeled off by the user and the polishing pad 10 as shown in FIG. 3A is pasted onto the surface of the lapping plate 31.

This back sheet 14 is attached to the back surface 11*b* of the aforementioned transparent pad 11 through the first adhesive layer 15. The transparent base sheet 16 comprises a non-foamed resin material of polyurethane, polyethylene, polystyrene, vinyl polychloride or acryl type. As shown by broken lines in FIG. 3A, this polishing pad 10 may be provided with the aforementioned indentation 12 on the back surface 11*b* of the transparent pad 11. Although not shown, throughholes penetrating from the front surface to the back surface may be provided to the back sheet 14 so as to improve the transparency of the corresponding portions of the polishing pad 10.

Figure 3B:
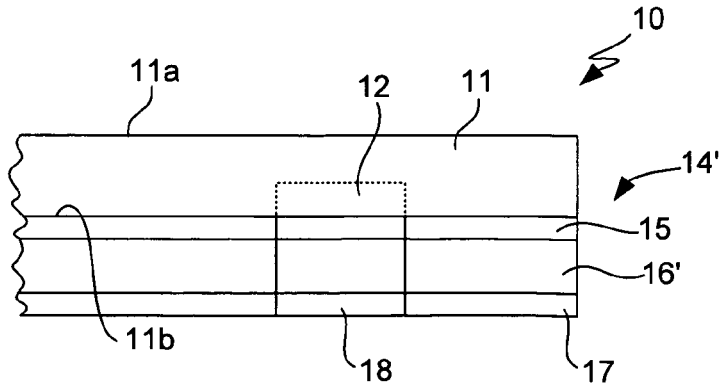

FIG. 3B shows another polishing pad 10 embodying this invention which may be produced with another back sheet 14' obtained by forming a first adhesive layer 15 on the front surface of an elastic sheet 16' of a non-woven cloth or foamed material and forming a second adhesive layer 17 on the back surface of this elastic sheet 16'. Since this elastic sheet 16' does not allow light to pass through, a throughhole 18 is preliminarily formed to penetrate it from its front surface to its back surface at a position corresponding to the lid 32 on the surface of the lapping plate 31.

This polishing pad 10 is adapted to be attached to the lapping plate 31 of the polishing devices 30*a* and 30*b* shown in FIGS. 10A and 10B through the second adhesive layer 17. As explained above with reference to FIG. 3A, a paper sheet for separation (not shown) is pasted onto the front surface of the first adhesive layer 15 and the back surface of the second adhesive layer 17 in order to prevent them from drying. Prior to an actual use, the paper sheet on the surface of the first adhesive layer 15 is peeled off by the user and the back sheet 14' is pasted onto the back surface of the transparent pad 11 through the first adhesive layer 15. At the time of the actual use, the paper sheet on the back surface of the second adhesive layer 17 is peeled off by the user and the polishing pad 10 as shown in FIG. 3B is pasted onto the surface of the lapping plate 31.

This back sheet 14' is attached to the back surface 11*b* of the aforementioned transparent pad 11 through the first adhesive layer 15. If the first adhesive layer 15 or the second adhesive layer 17 is formed so as to cover the slot 18 partially or completely, a transparent adhesive is to be employed.

With the polishing pad 10 having the adhesive layer 13 formed on the back surface 11*b* of the transparent pad 11 as shown in FIG. 2 or having the back sheet 14 or 14' attached as shown in FIG. 3, the judgment of the time to end the polishing process may not be made accurately if the transparency is less than 10%. It is therefore preferable that the transparent pad 11 should have transparency equal to or greater than 10% or preferably equal to or greater than 30% for light of at least one wavelength within the range of 350 nm–900 nm. For example, transparency may be equal to or greater than 10% for light of wavelength in the range of 370 nm–900 nm or in the range of 390 nm–900 nm. Transparency may be equal to or greater than 30% for light of wavelength in the range of 400 nm–900 nm or in the range of 450 nm–900 nm.

The polishing pad 10 of this invention is produced by firstly obtaining the transparent pad 11 having the polishing surface 11*a*. This transparent pad 11 is produced by preparing a planar non-foamed member by filling a molding block with a liquid mixture of a resin material of polyurethane, polyethylene, polystyrene, vinyl polychloride or acryl type and a hardening agent and hardening this mixture, abrading both surfaces of this planar member to a specified thickness and polishing both surfaces by using a tool of a known kind for surfacing with diamond abrading particles affixed to the surface.

A resin material with purity equal to or greater than 60%, or preferably 90%, is used for the production of the transparent pad 11. Examples of polyurethane type of resin material include tolylene diisocyanate with purity 60% and preferably metaxylene diisocyanate and hexamethylene diisocyanate with purity 90% or greater. The transparency in a low-wavelength region can be improved by using a resin of such a high level of purity. Examples of hardening agent that may be used include 3,3'-dichloro-4,4'-diaminodiphenyl methane (such as MOCA (tradename) produced by Dupont), compound material (complex) of methylene dianiline and sodium chloride (such as Caytur, (tradename) produced by Dupont) and mixtures of dimethylthio 2,4-toluene diamine and dimethylthio 2,6-toluene diamine (such as Ethacure 300 (tradename) produced by Ethyl Corporation).

The indentation 12 on the back surface 11*b* of the transparent pad 11, as shown in FIGS. 1, 2 and 6, may be formed mechanically in a desired shape by a known lathing method. Similarly, the grooves 19 may be formed mechanically on the front surface of the transparent pad 11 by a known lathing method.

The adhesive layer 13 of FIG. 2 on the back surface 11*b* of the transparent pad 11 is formed by spreading an adhesive agent thinly over the back surface 11*b* of the transparent pad 11 prepared as explained above by using a knife or the like.

The back sheet 14 as shown in FIG. 3A is produced by using a knife or the like to spread an adhesive agent on the front surface of the transparent base sheet 16 to form the first adhesive layer 15 and on its back surface to form the second adhesive layer 17. The back sheet 14 can be attached to the back surface 11*b* of the transparent pad 11 by way of the first adhesive layer 15.

The back sheet 14' as shown in FIG. 3B is produced by forming the slot 18 from the front surface to the back surface through the elastic sheet 16' and using a knife or the like to spread an adhesive agent on the front surface of this elastic sheet 16' to form the first adhesive layer 15 and on its back surface to form the second adhesive layer 17. This back sheet 14' can be attached to the back surface 11*b* of the transparent pad 11 by way of the first adhesive layer 15.

TEST EXAMPLE 1

A molding block was filled with a liquid mixture of 100 parts of urethane prepolymer (metaxylene diisocyanate with purity 90% or greater) heated to 80° C. and 30 parts of a hardening agent (aforementioned MOCA) heated to 120° C. It was kept at 120° C. for 10 minutes for a molding process and then taken out of the molding block. After this planar non-foamed member was kept in a thermostatic oven at 100° C. for 12 hours, it was cooled down naturally. After this planar non-foamed member was rapped into a circular shape of 24 inches in diameter, it was ground to a specified thickness and both its surfaces were polished to an average surface roughness Ra of 1 μm (nearly mirror surface) by means of a surfacing tool of a known kind having abrading particles of diamond affixed to the surface. A transparent pad of thickness 1.5 mm was thus obtained. This is referred to as the polishing pad of Test Example 1.

TEST EXAMPLE 2

Another transparent pad was produced in the same way as above except that a resin material with a lower purity (60% instead of 90%) was used. This is referred to as the polishing pad of Test Example 2.

Experiment 1

Transparency of these transparent pads of Test Examples 1 and 2 was measured in order to study the effects of the purity of the hardening agent added to the transparent resin. The measurement was taken by cutting out a test piece of 30 mm×30 mm with thickness 1.5 mm from each polishing pad and by using a spectrophotometer (DR/2010 (tradename) produced by Central Kagaku Kabushiki Kaisha) under the conditions shown in Table 1.

TABLE 1

| | |
|---|---|
| Resolution | 1 nm |
| Light-emitting element (light source) | Halogen lamp |
| Light-receiving element | Silicon photodiode |
| Range of wavelength | 350 nm–900 nm |

Figure 7:
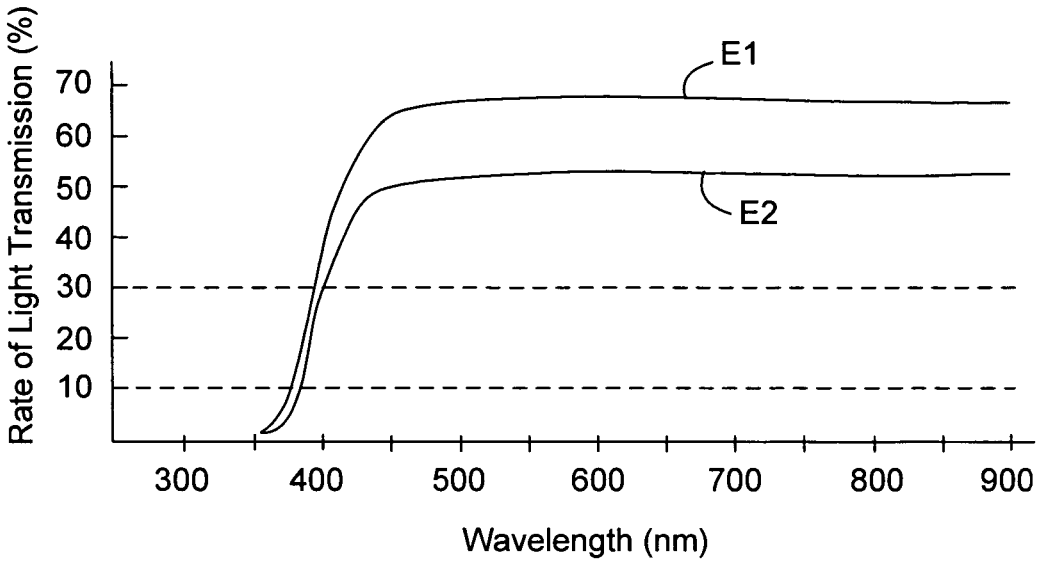
FIG. 7 is a graph for showing the transparency of the polishing pads of Test Examples 1 and 2.

The results of Experiment 1 are shown in FIG. 7 wherein the curve indicated by symbol E1 represents the transparency of the polishing pad of Test Example 1 and the curve indicated by symbol E2 represents the rate of transparency of the polishing pad of

TEST EXAMPLE 2

These curves show that the transparency of the polishing pad of Test Example 1 is 10% or higher in the wavelength range of about 370 nm and over and 30% or higher in the wavelength range of about 400 nm and over. With the polishing pad of Test Example 2 produced by using a hardening agent with lower purity, the transparency was 10% or higher in the wavelength range of about 390 nm and over and 30% or higher in the wavelength range of about 400 nm and over. It can thus be concluded that a polishing pad with higher transparency at a shorter wavelength can be produced by using a hardening agent with higher purity.

A similar conclusion could be obtained by using another polyurethane resin (hexamethylene diisocyanate) with purity of 90% or greater in Test Example 1.

TEST EXAMPLES 3–5

Polishing pads of Test Examples 3–5 were produced similarly as that of Test Example 2 by using the same material and under the same conditions except that the thickness was 1.5 mm for Test Example 3, 1.0 mm for Test Example 4 and 0.5 mm for Test Example 5. The average surface roughness Ra was equal to or less than 1 μm (nearly mirror surface) for each of them.

Experiment 2

Transparency of the polishing pads of Test Examples 3–5 was measured to study the relationship with the thickness. The measurement was taken as explained above with reference to Experiment 1 by cutting out a test piece of 30 mm×30 mm with thickness 1.5 mm from each polishing pad and by using a spectrophotometer (DR/2010 (tradename) produced by Central Kagaku Kabushiki Kaisha) under the conditions shown in Table 1.

Figure 8:
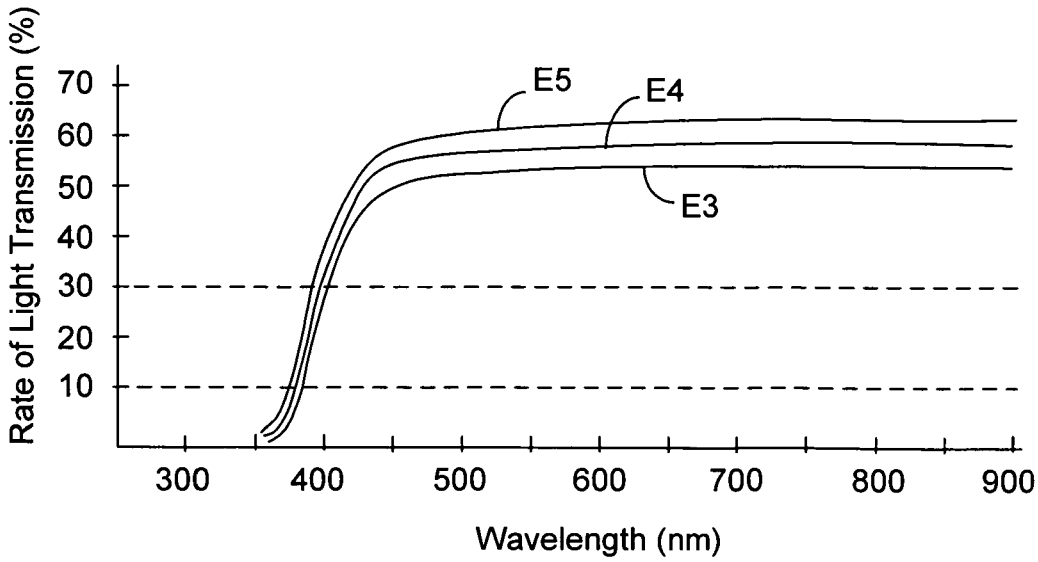
FIG. 8 is a graph for showing the transparency of the polishing pads of Test Examples 3, 4 and 5.

The results of Experiment 2 are shown in FIG. 8 wherein the curves indicated by symbols E3–E5 respectively represent the transparency of the polishing pads of Test Examples 3–5. These curves show that the transparency can be improved by reducing the thickness of the polishing pad.

TEST EXAMPLES 6–8

Polishing pads of Test Examples 6–8 were produced similarly as those of Test Examples 3–5 by using the same material and under the same conditions except that their surfaces were polished to an average surface roughness Ra of 3 μm by using a surfacing tool of a known kind with abrading particles of diamond affixed to its surface. Their thickness was 1.5 mm for Test Example 6, 1.0 mm for Test Example 7 and 0.5 mm for Test Example 8. The average surface roughness Ra of the back surface of each polishing pad was equal to or less than 1 μm (nearly mirror surface).

Experiment 3

Transparency of the polishing pads of Test Examples 6–8 was measured to study the relationship with the thickness of polishing pads with a rough front surface. The measurement was taken as explained above with reference to Experiment 1 by cutting out a test piece of 30 mm×30 mm with thickness 1.5 mm from each polishing pad and by using a spectrophotometer (DR/2010 (tradename) produced by Central Kagaku Kabushiki Kaisha) under the conditions shown in Table 1.

Figure 9:
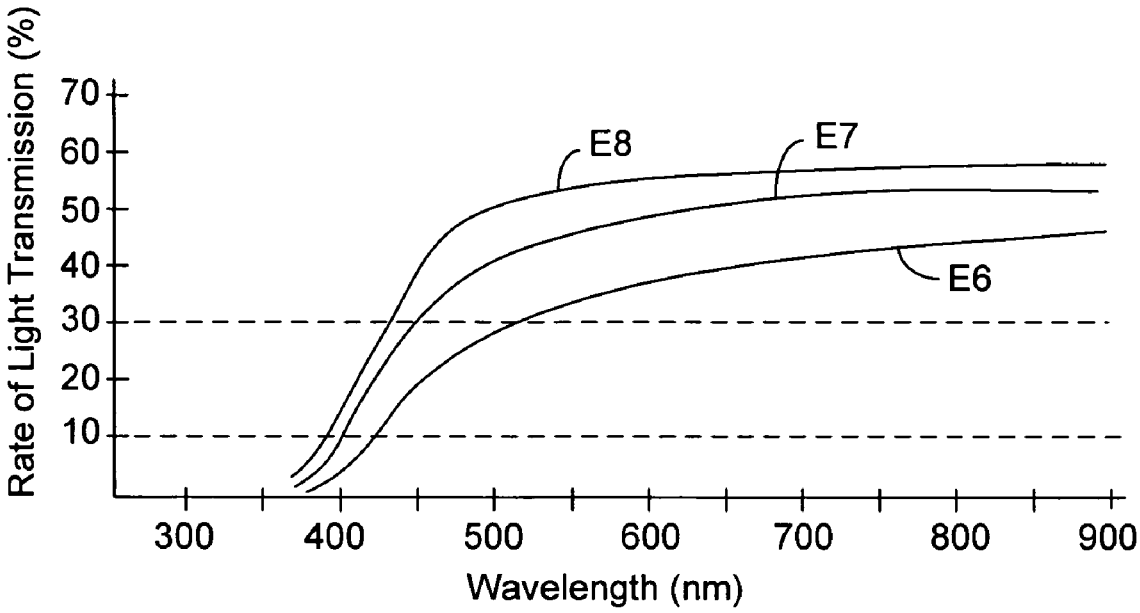
FIG. 9 is a graph for showing the transparency of the polishing pads of Test Examples 6, 7 and 8.
Figure 11:
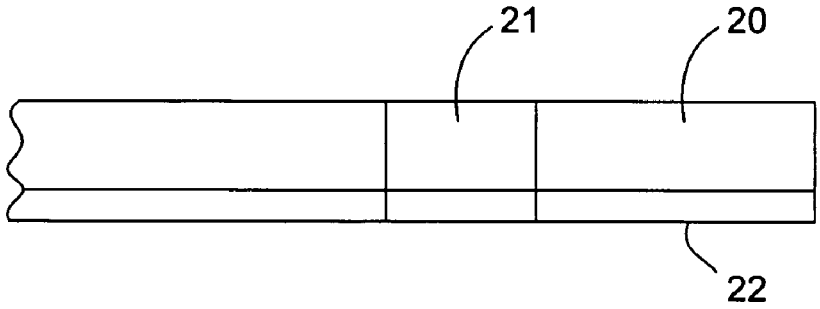
FIG. 11 is a sectional view of a prior art polishing pad.

The results of Experiment 3 are shown in FIG. 9 wherein the curves indicated by symbols E6–E8 respectively represent the transparency of the polishing pads of Test Examples 6–8. These curves show with reference to those in FIG. 8 that the transparency drops if the surface is made rough but can be improved by making the polishing pad thinner.

What is claimed is:

1. A polishing pad comprising a transparent pad with a front surface and a back surface, said front surface having a polishing surface with an average surface roughness of 5 μm or less, said front surface having grooves, and said back surface having an indentation opposite said grooves.

2. The polishing pad of claim 1 having a rate of light transmission equal to or greater than 10% for light of at least one wavelength in 350 nm–900 nm.

3. The polishing pad of claim 1 having a rate of light transmission equal to or greater than 30% for light of at least one wavelength in 350 nm–900 nm.

4. The polishing pad of claim 1 wherein said transparent pad comprises a non-foamed material of a resin selected from the group consisting of polyurethane resins, polyethylene resins, polystyrene resins, vinyl polychloride resins and acryl resins.

5. The polishing pad of claim 1 further comprising an adhesive layer of an adhesive material formed on said back surface of said transparent pad.

6. The polishing pad of claim 5 having a rate of light transmission equal to or greater than 10% for light of at least one wavelength in 350 nm–900 nm.

7. The polishing pad of claim 5 having a rate of light transmission equal to or greater than 30% for light of at least one wavelength in 350 nm–900 nm.

8. The polishing pad of claim 7 wherein said adhesive material is selected from the group consisting of polyester adhesives, polyethylene adhesives, epoxy adhesives, polyurethane adhesives, acryl adhesives and natural rubber adhesives.

9. The polishing pad of claim 1 further comprising a back sheet attached to a back surface of said transparent pad, said back sheet comprising a transparent base sheet, a first adhesive layer and a second adhesive layer, said first adhesive layer being formed on a front surface of said transparent base sheet, said second adhesive layer being formed on a back surface of said transparent base sheet, said back sheet being attached to said back surface of said transparent pad through said first adhesive layer.

10. The polishing pad of claim 9 wherein said transparent base sheet comprises a non-foamed sheet of a resin material selected from the group consisting of polyurethane resins, polyethylene resins, polystyrene resins, vinyl polychloride resins and acryl resins.

11. The polishing pad of claim 1 further comprising a back sheet attached to a back surface of said transparent pad, said back sheet comprising an elastic sheet having a slot that penetrates from said front surface to said back surface, a first adhesive layer and a second adhesive layer, said first adhesive layer being formed on a front surface of said elastic sheet, said second adhesive layer being formed on a back surface of said elastic sheet, said back sheet being attached to said back surface of said transparent pad through said first adhesive layer.

12. The polishing pad of claim 11 wherein said elastic sheet is one selected from non-woven cloth sheets and foamed sheets.

13. A method of producing a polishing pad, said method comprising the steps of:

filling a molding block with a liquid mixture of a hardening agent and a resin material selected from the group consisting of polyurethane resins, polyethylene resins, polystyrene resins, vinyl polychloride resins and acryl resins;

hardening said liquid mixture to thereby obtain a planar non-foamed member;

polishing both surfaces of said planar non-foamed member to obtain a transparent pad having an average surface roughness of 5 μm or less as said polishing pad; and forming grooves on a front surface of said transparent pad and an indentation on a back surface of said transparent pad opposite said grooves.

14. The method of claim 13 further comprising the step of forming an adhesive layer comprising an adhesive on a back surface of said transparent pad.

15. The method of claim 13 further comprising the back sheet attaching step for attaching on a back surface of said transparent pad a back sheet that comprises a transparent base sheet, a first adhesive layer and a second adhesive layer, said back sheet attaching step comprising the steps of:

forming said first adhesive layer on a front surface of said transparent base sheet;

forming said second adhesive layer on a back surface of said transparent base sheet; and attaching said back sheet on said back surface of said transparent pad through said first adhesive layer.

16. The method of claim 13 further comprising the back sheet attaching step for attaching on a back surface of said transparent pad a back sheet that comprises an elastic sheet having a slot penetrating from a front surface thereof to a back surface thereof, a first adhesive layer and a second adhesive layer; said back sheet attaching step comprising the steps of:

forming said slot through said elastic sheet;

forming said first adhesive layer on said front surface of said elastic sheet;

forming said second adhesive layer on said back surface of said elastic sheet; and attaching said back sheet on said back surface of said transparent pad through said first adhesive layer.

* * * * *